US009168204B2

(12) United States Patent
Pfenniger et al.

(10) Patent No.: US 9,168,204 B2
(45) Date of Patent: Oct. 27, 2015

(54) TEAT UNIT

(75) Inventors: Erich Pfenniger, Ebikon (CH); Mario Rigert, Buchrain (CH)

(73) Assignee: MEDELA HOLDING AG, Baar (CH)

( * ) Notice: Subject to any disclaimer, the term of this patent is extended or adjusted under 35 U.S.C. 154(b) by 370 days.

(21) Appl. No.: 12/856,992

(22) Filed: Aug. 16, 2010

(65) Prior Publication Data

US 2011/0042339 A1 Feb. 24, 2011

(30) Foreign Application Priority Data

Aug. 20, 2009 (CH) ..... 1292/09

(51) Int. Cl.

| | |
|---|---|
| ***A47G 19/22*** | (2006.01) |
| ***A61J 11/02*** | (2006.01) |
| ***A61J 9/04*** | (2006.01) |
| ***A61J 11/04*** | (2006.01) |

(52) U.S. Cl.

CPC .. *A61J 11/02* (2013.01); *A61J 9/04* (2013.01); *A61J 11/04* (2013.01)

(58) Field of Classification Search

CPC ..... A61J 9/04; A61J 11/02; A61J 11/045; A61J 11/04; A61J 9/00

USPC ..... 215/11.1, 11.5, 40, 42; 220/303, 717, 220/714, 203.18, 719

See application file for complete search history.

(56) References Cited

U.S. PATENT DOCUMENTS

| | | | |
|---|---|---|---|
| 2,084,099 | A | 6/1937 | MacCoy |
| 2,516,084 | A | 7/1950 | Wells |
| 2,529,794 | A | 11/1950 | Brown |
| 2,745,568 | A | 5/1956 | Newton |
| 4,548,157 | A | 10/1985 | Hevoyan |
| 4,730,744 | A | 3/1988 | Vinciguerra |
| 4,865,207 | A | 9/1989 | Joyner et al. |
| 5,499,729 | A | 3/1996 | Greenwood et al. |

(Continued)

FOREIGN PATENT DOCUMENTS

| | | |
|---|---|---|
| CA | 1035728 | 8/1978 |
| CA | 2650714 A1 | 12/2007 |

(Continued)

OTHER PUBLICATIONS

Swiss Search Report for corresponding Swiss Application No. CH01292/09 dated Nov. 17, 2009.

(Continued)

*Primary Examiner* — Fenn Mathew
*Assistant Examiner* — Cynthia Collado
(74) *Attorney, Agent, or Firm* — McDonnell Boehnen Hulbert & Berghoff LLP

(57) ABSTRACT

A teat unit has a teat, a securing device for securing the teat on a liquid container, and an air valve, the securing device having a first securing part and a second securing part. The air valve has a first valve part, which is arranged in the first securing part, and a second valve part, which is arranged in the first or in the second securing part. The air valve opens and closes with respect to the second securing part. The valve is preferably a diaphragm valve, and the first valve part is a valve diaphragm. This teat unit functions very reliably even at very small pressure differences between the bottle and the environment. Moreover, the range of function of the various teat units of the same type is relatively narrow, such that different teat units function very similarly and the air valves are actuated at similar pressure differences.

17 Claims, 6 Drawing Sheets

(56) References Cited

U.S. PATENT DOCUMENTS

| | | | | |
|---|---|---|---|---|
| 5,791,503 | A * | 8/1998 | Lyons | 215/11.5 |
| 6,161,710 | A * | 12/2000 | Dieringer et al. | 215/11.4 |
| 8,016,142 | B2 * | 9/2011 | Renz | 215/11.5 |
| 8,333,299 | B2 * | 12/2012 | Kemper et al. | 220/719 |
| 2006/0169694 | A1 * | 8/2006 | Kemper | 220/303 |
| 2008/0099422 | A1 | 5/2008 | Rees | |
| 2008/0237176 | A1 | 10/2008 | Pillado | |
| 2009/0071926 | A1 | 3/2009 | Berkovitch et al. | |
| 2009/0139950 | A1 | 6/2009 | Greter et al. | |
| 2010/0294764 | A1 * | 11/2010 | Kemper et al. | 220/203.18 |

FOREIGN PATENT DOCUMENTS

| | | | |
|---|---|---|---|
| CN | 1972660 | | 5/2007 |
| CN | 101453978 | | 6/2009 |
| DE | 2341762 | A | 1/1975 |
| DE | 10157071 | | 3/2003 |
| DE | 10157071 | C1 | 3/2003 |
| DE | 202007016416 | | 2/2008 |
| EP | 1374826 | A1 | 1/2004 |
| FR | 2748391 | A1 | 11/1997 |
| GB | 1432798 | | 4/1976 |
| NL | 1005120 | | 7/1998 |
| WO | 03/055766 | A1 | 7/2003 |
| WO | 2005/112869 | | 12/2005 |
| WO | 20071137440 | A2 | 12/2007 |

OTHER PUBLICATIONS

International Search Report for corresponding International App. No. PCT/CH2010/000198, dated Nov. 12, 2010.

* cited by examiner

TEAT UNIT

CROSS REFERENCE TO RELATED APPLICATIONS

This application claims priority under 35 USC 119(e) to Swiss Application No. 01292/09, filed on Aug. 20, 2009, the entire contents of which is incorporated herein by reference.

TECHNICAL FIELD

The present invention relates to a teat unit.

BACKGROUND

Babies who are not breastfeeding usually drink from a bottle provided with a teat.

The bottle is usually hard. That is to say, it does not deform during feeding, nor can it be pressed together by the usual forces applied by hand. During feeding, therefore, air has to be able to enter the bottle. This is usually achieved by the threaded ring with which the teat is secured on the bottle not being completely sealed with respect to the neck of the bottle. If the threaded ring is twisted too tightly on the neck of the bottle, too little air can flow into the bottle, and the baby has to make too much effort when feeding. However, if the threaded ring is applied too loosely to the neck of the bottle, milk drips out of the bottle from the threaded ring.

DE 23 41 762 proposes providing the suction opening of the teat with a non-return valve and providing the securing flange of the teat with an air valve. The air valve is formed by a two-stage hole and by a U-shaped or V-shaped diaphragm section with an X-shaped or Y-shaped cut.

WO 2007/137440 discloses a teat unit with a teat and a dimensionally stable receiving head for receiving the teat. The one-piece receiving head is provided with a threaded ring, such that it can be screwed onto the neck of a feeding bottle or a drinking cup. The teat is mounted on the hemispherical receiving head and not secured to the threaded ring. The teat has an air sealing lip that can open and close an air opening in the receiving head.

US 2008/0237176, U.S. Pat. No. 2,529,794, U.S. Pat. No. 2,516,084, U.S. Pat. No. 2,084,099, U.S. Pat. No. 4,730,744, U.S. Pat. No. 5,499,729 and U.S. Pat. No. 4,865,207 disclose feeding bottles with teats, which feeding bottles are provided with an air inlet device at their end directed away from the teat.

U.S. Pat. No. 2,745,568 discloses a teat unit with a non-return valve and with a second valve. Liquid that has collected in the teat can flow back through this second valve into the bottle.

SUMMARY OF THE INVENTION

The object of the invention is to make available a teat unit that permits optimal air flow during feeding.

The teat unit according to the invention has a teat, a securing device for securing the teat on a liquid container, and an air valve, the securing device having a first securing part and a second securing part, and the air valve having at least a first valve part and a second valve part. According to the invention, the first valve part is arranged in the first securing part, and the second valve part is arranged in the second and/or in the first securing part. The air valve opens and closes with respect to the second securing part.

The air valve is preferably a diaphragm valve, and the first valve part is a valve diaphragm. The second valve part is preferably a closure surface that closes an opening arranged in the diaphragm or freed from the diaphragm.

By using an air valve arranged and designed in this way, the liquid container is aerated within a relatively narrow predetermined range. The underpressure in the liquid container does not quantitatively exceed a predetermined underpressure. The valve preferably opens at a pressure difference of approximately 30 mmHg between container and ambient pressure. The air valve works reliably at relatively small pressure differences between the internal pressure of the bottle and the external suction pressure that is applied. The air valve works almost independently of how tight the connection is between teat unit and liquid container. In this way, the persons using the teat unit, i.e. the parents or carers, cannot appreciably influence the mode of function of the air valve. On the one hand, incorrect use is therefore ruled out. On the other hand, it is possible to ensure that various teat units of the same type react or function in the same way within a relatively narrow range and the baby is therefore unaware of any difference when changing from one teat unit to another teat unit of the same type.

Another advantage is that this arrangement has a good sealing action when there is an overpressure in the bottle relative to the ambient pressure.

A further advantage is that this teat unit and in particular the air valve can be easily cleaned, and frequent cleaning does not adversely affect the functionality of the air valve. The teat unit is relatively simple to produce.

In a preferred embodiment, the two securing parts form an air channel that opens into an air opening leading to the outside. This air channel preferably extends in a labyrinthine configuration between the two securing parts, such that any liquid emerging from the container through the valve opening is trapped in the labyrinth and cannot escape to the outside.

In a preferred embodiment, the two securing parts are rigid, at least in the area of the air valve, and they are designed such that they can be connected to each other.

The teat is preferably arranged at a distance from the air valve, such that it cannot exert any influence on the mode of function of the air valve. It preferably has a radially inwardly or outwardly protruding flange, which is held between the first base part and second base part.

In a preferred embodiment, the diaphragm has an air through-flow opening that is permanently open, and it can be closed by means of the second securing part. Thus, the diaphragm preferably does not have a slit, but instead a free opening. This free opening is preferably circular, elliptic, oval or annular. The free opening ensures that the valve opens reliably even at small pressure differences. A further improvement is achieved if the air through-flow opening is strengthened at its circumference. It has also proven advantageous, in this context, if the diaphragm has a planar main surface and a funnel or truncated cone arranged in the main surface, the air through-flow opening being arranged in the funnel or in the truncated cone. The diaphragm is preferably secured about its entire circumference or periphery in the first securing part.

In a preferred embodiment, the first securing part has a circumferential sealing ring for bearing in a leaktight manner on an end face of the liquid container. The diaphragm and the sealing ring are preferably designed together in one piece. This makes production easier and ensures optimal sealing.

In a preferred embodiment, the first securing part is a base part and the second securing part is a receiving head, wherein the teat has a flange that is held between receiving head and base part, wherein the receiving head and the base part can be connected to each other via a releasable plug connection, wherein the receiving head for this purpose has plug elements that can be plugged into the base part and that are designed to secure the assembled base part and receiving head on the liquid container. The air valve is preferably arranged in the area of a plug connection of this kind, such that the second securing part serving as the closure of the diaphragm is pressed optimally onto the diaphragm.

The first securing part preferably has an annular main body and a truncated cone formed integrally in the main body, wherein a liquid through-flow channel extends along a longitudinal centre axis of the truncated cone, and wherein the diaphragm of the air valve is arranged in the circumferential surface of the truncated cone. The diaphragm of the air valve is preferably substantially flush with the circumferential surface of the truncated cone.

Further embodiments are set forth in the dependent claims. Any desired combinations of the above embodiments and variants are possible.

BRIEF DESCRIPTION OF THE FIGURES

A preferred embodiment of the invention is described below with reference to the drawings, which serve solely for the purpose of illustration and are not to be interpreted as limiting the invention. In the drawings.

DETAILED DESCRIPTION

Figure 1:
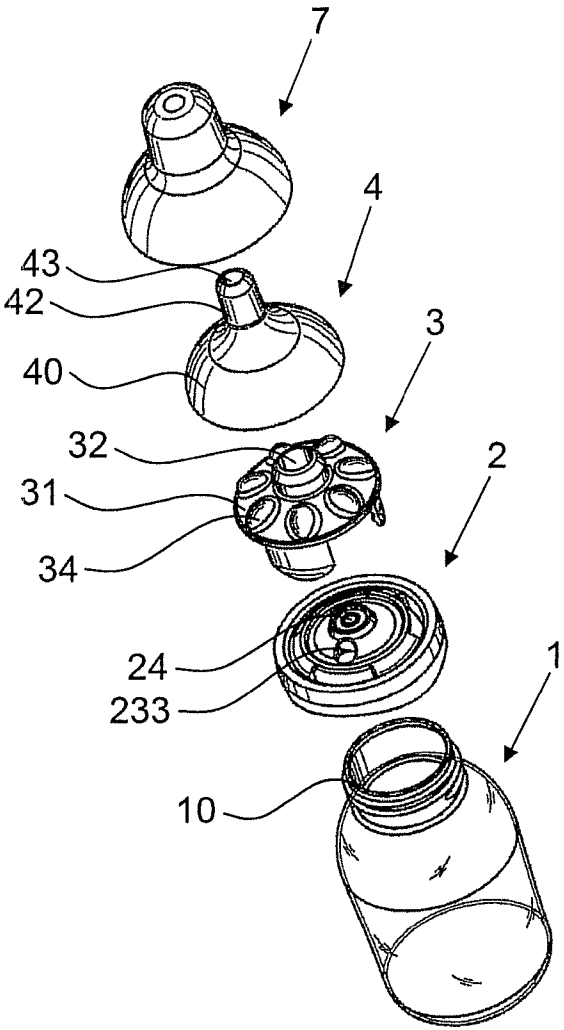
FIG. 1 shows an exploded view of a teat unit according to the invention with a liquid container and cap.

FIG. 1 shows an illustrative embodiment of a teat unit 2, 3, 4 according to the invention with a liquid container, here a feeding bottle 1, and a cap 7. The liquid container is rigid. It cannot therefore be pressed together by hand or by the feeding action.

The teat unit is composed of a base ring 2, a receiving head 3 and a teat 4. The teat 4 is made of a relatively soft material, for example silicone or rubber, in a known manner. It has a main body 40 with an inwardly directed circumferential flange 41, which can be seen in FIG. 3. The main body 40 is preferably dome-shaped or in the form of a truncated cone. The main body 40 narrows to a mouthpiece 42, which has a suction opening 43 at its free end. A baby is able to suck liquid from the bottle 1 through this suction opening 43.

The base ring 2 and the receiving head 3 are used for securing the teat 4 on the bottle 1. They are preferably made of a harder plastic material, for example polypropylene (PP) or a polyamide. As is explained below, individual areas of these securing parts can be made of a softer material, for example of silicone, rubber or TPE.

The receiving head 3 has a main body 31 which, towards the teat 4, has a tubular or frustoconical elevation 35. A through-opening 32 is located in the free end of the elevation 35. Support structures 34, designed here in a cushion shape, are preferably present on the main body 31. They can also have other shapes. They are preferably made of a softer material than the main body 31, and they can be produced together with the latter by two-component or multi-component injection moulding. For example, the main body 31 is made of PP or a polyamide, and the support structures 34 are made of silicone, rubber or TPE.

Figure 3:
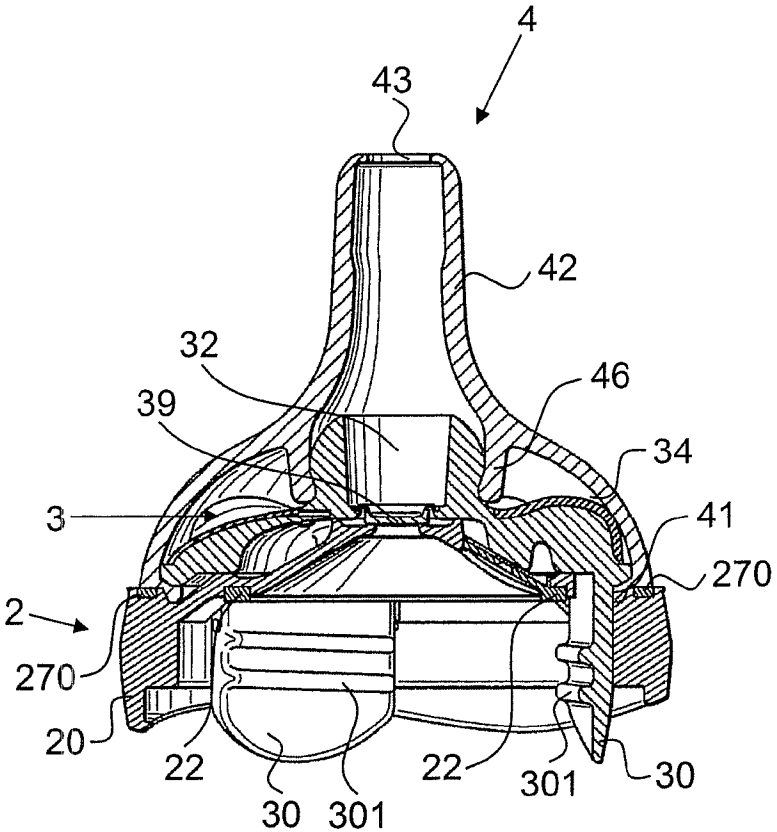
FIG. 3 shows a longitudinal section through the teat unit according to FIG. 2.

The teat 4 can be pushed with its flange 41 over the margin 320 of the main body 31. The elevation 35 protrudes into the area of the mouthpiece 42, and the through-opening 32 forms the connection between bottle 1 and suction opening 43. The support structures 34 support the main body 40 of the teat 4 and/or the transition area between the main body 40 and the mouthpiece 42. If, as can be seen in FIG. 3, the teat 4 has an inner skirt 46 formed integrally on the mouthpiece 42, the skirt 46 can bear sealingly on the elevation 35 or be brought into engagement with the latter.

Plug elements 30 are also formed integrally on the main body 31. They protrude from the main body 31 in the form of downwardly extending legs. In this example, three plug elements 30 are present. However, it is possible for more plug elements 30 to be present, or just two plug elements 30 or just a single plug element 30. The inner faces of the plug elements 30 form a common inner thread 301.

The base part 2 has an annular main body 20. The central inner area of the base part 2 is formed by a funnel or truncated cone 25, in the free end of which a through-opening 24 is present. The latter forms the connection from the suction opening 43 and through-opening 32 of the receiving head 3 to the opening of the bottle 1. These openings 43, 32, 24 are preferably all arranged in the longitudinal centre axis of the device and are flush with one another along this axis.

The annular body 20 has an opening 233 for receiving an air valve according to the invention. The air valve is described further below in the text.

The annular body 20 has slits 21 into which the plug elements 30 of the receiving head can be fitted. The annular body 20 can be mounted onto a threaded neck 10 of the bottle 1, the inner thread of the plug elements 30 being brought into engagement with the threaded neck 10. In this way, the base ring 2 and receiving head 3 can be secured on the bottle 1. The base ring 2 and receiving head 3 are braced against each other when screwed tight. If the teat 4 with its flange now surrounds the margin 320 of the receiving head 3, or the teat 4 is held in another way between receiving head 3 and base ring 2, it can be clamped sealingly in this position between the two securing parts. The teat 4 can be applied when the securing parts 2, 3 have already been plugged together, but before being screwed onto the bottle 1, or it can be mounted first on the receiving head 3, with the latter only then being connected to the base part 2.

Figure 2:
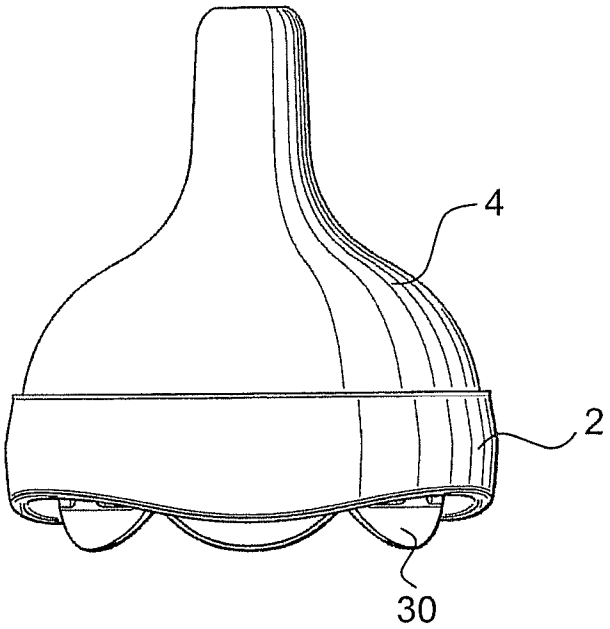
FIG. 2 shows the teat unit according to FIG. 1 in the assembled state.
Figure 7:
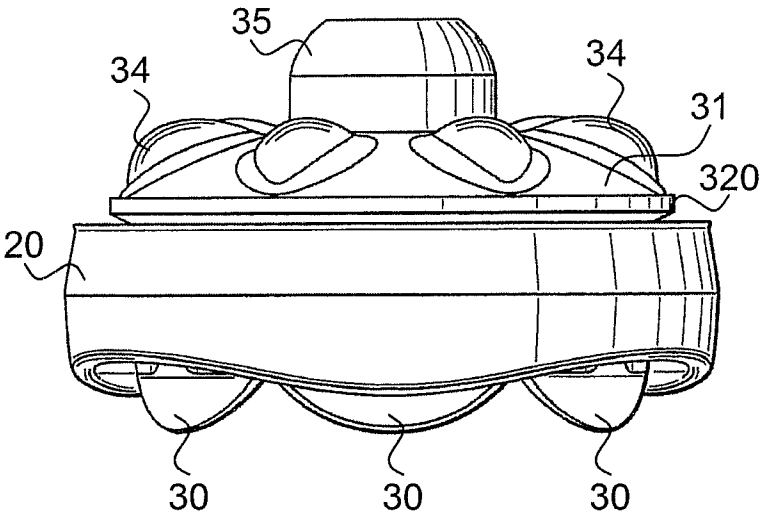
FIG. 7 shows a side view of the base part plugged together with the receiving head.

An assembled state of base part 2 and receiving head 3 is shown in FIG. 7. FIG. 2 shows the assembled state of the teat unit with teat 4, base part 2 and receiving head 3.

FIG. 3 shows a longitudinal section through this assembled teat unit according to FIG. 2. A non-return valve 39, which closes the through-opening 24 in the truncated cone 25, is preferably, but not necessarily, provided in the elevation 35.

Figure 5:
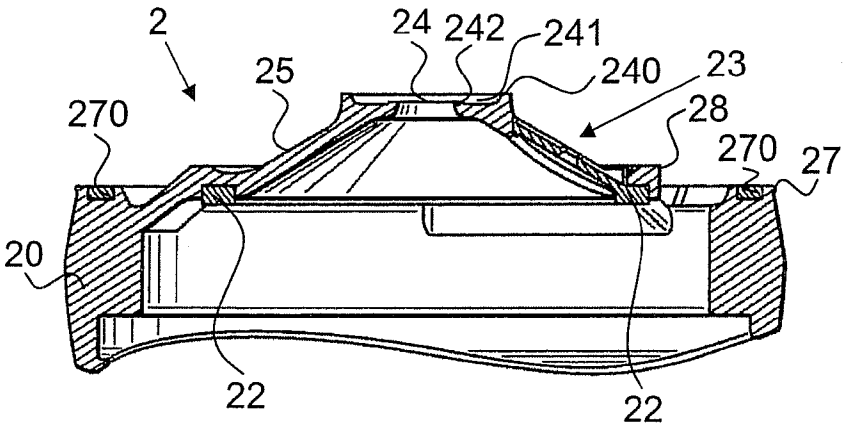
FIG. 5 shows a longitudinal section through the base part according to FIG. 4.
Figure 10:
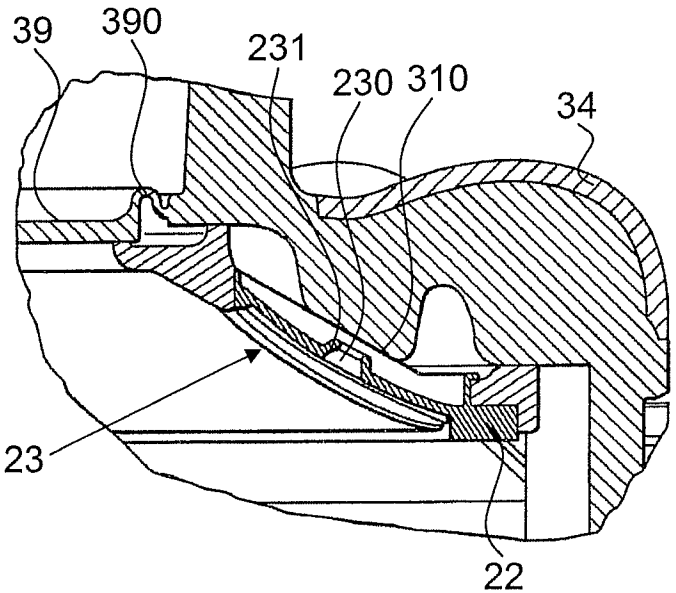
FIG. 10 shows the view according to FIG. 9 with the air valve opened.
Figure 9:
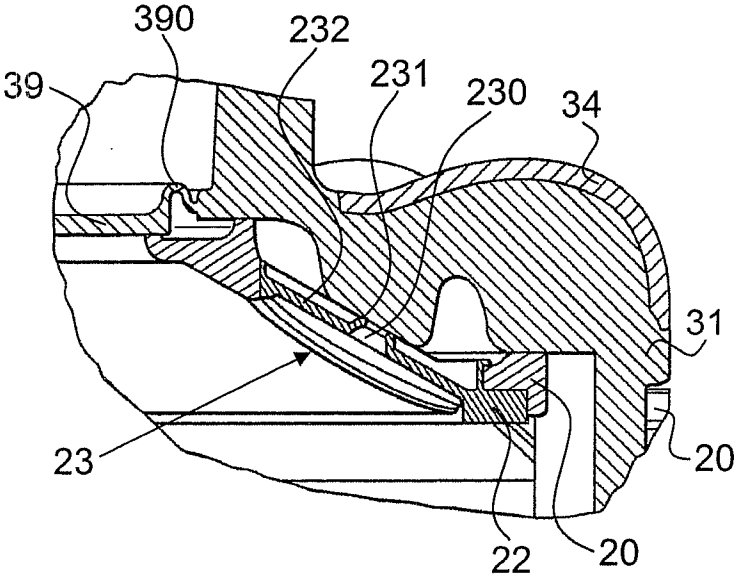
FIG. 9 shows an enlarged view according to FIG. 8 with the air valve closed.

The associated valve opening 390 can be seen in FIGS. 9 and 10. The liquid flows through this valve opening into the mouthpiece 42 and to the suction opening 43. The non-return valve 39 and the support structures 34 are preferably produced from one of the abovementioned soft materials by multi-component injection moulding together with the harder main body 31 of the receiving head 3. The diaphragm of the non-return valve 39 bears on the second upper sealing edge 242 of the base part 2, as can be seen in FIG. 5. A first upper sealing edge 240 extending around this second upper sealing edge 242 seals off the area of the valve opening 390 from the outside. In the area of the valve opening 390 and between the two upper sealing edges 240, 242, the base part 2 has a circumferential planar surface 241.

The base part 2 also has soft and hard areas, which are preferably produced from the abovementioned materials by common multi-component injection moulding. Thus, a circumferential upper sealing ring 270 is present, on which the flange 41 of the teat 4 bears.

As can also be seen from FIG. 3, the base part preferably has a circumferential lower sealing ring 22. The latter is arranged at the foot of the truncated cone 25 and is likewise preferably made of one of the abovementioned soft materials. It bears on the upper end margin of the bottle neck 10 and seals off the outer area of the base part 2, i.e. the annular body 20, with respect to the bottle 1.

Figure 4:
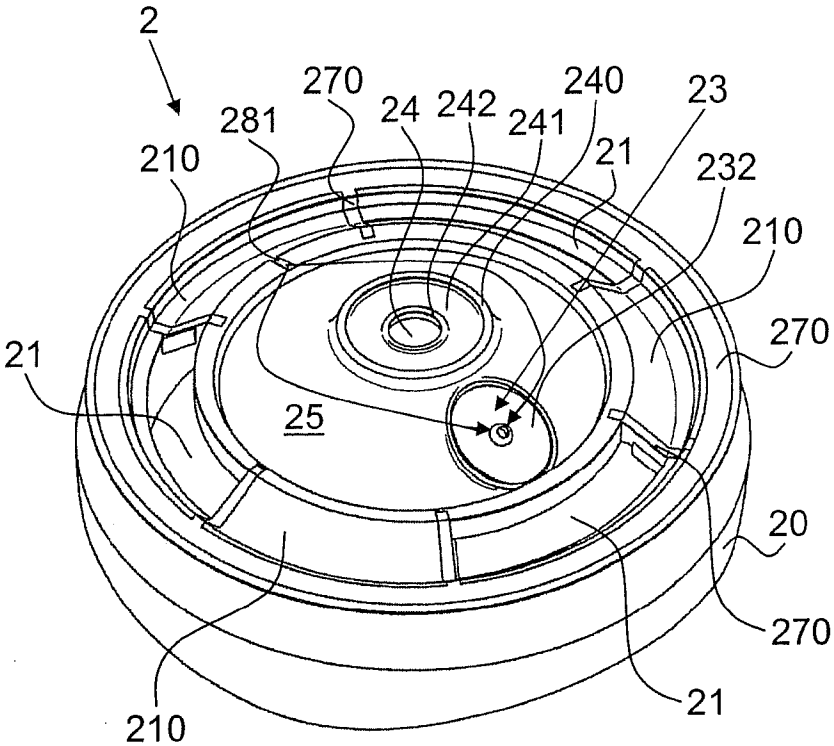
FIG. 4 shows a perspective view of a base part according to FIG. 1.
Figure 6:
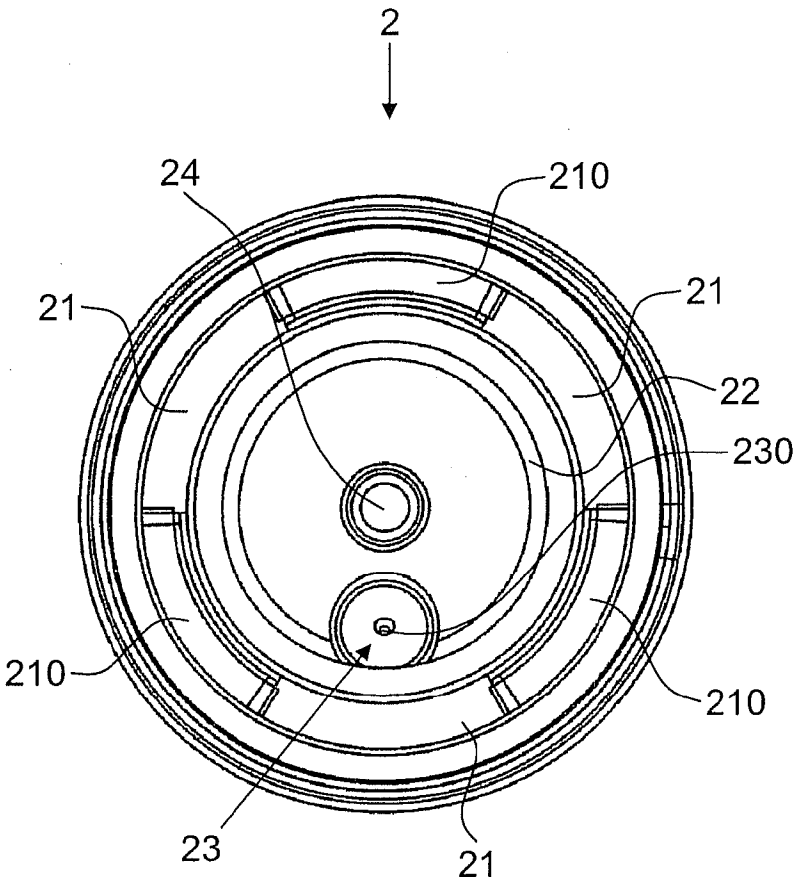
FIG. 6 shows a view of the base part from underneath.

The base part 2 can be seen in detail in FIGS. 4 to 6. In this example, it has three slits 21 that extend at equal distances along the circular circumference and are correspondingly curved. The slits 21 are followed by webs 210 arranged between them. The circumferential outer margin of the annular body 20 has an outer sealing edge 27, which is followed by the already mentioned upper sealing ring 270. On the inner face of the slits 21, there follows an inner sealing edge 28, which is adjoined by the truncated cone 25. The inner sealing edge 28 extends fully about the circumference, except for one or more air openings 281. Between the webs 210 and slits 21, the upper sealing ring 270 has fingers which extend across the inner sealing edge 28. The at least one, preferably exactly one, air opening 281 connects the truncated cone 25 to a web 210 or to a slit 21. Here, the connection is made via a web.

According to the invention, the base part 2 is provided with a first part of an air valve. In this embodiment, this first part is formed by a diaphragm 23. The second part of the valve is formed by a valve closure surface 310, which will be described later. The valve opens and closes an air opening between the two securing parts, i.e. in this example the base part 2 and the receiving head 3. The air valve is arranged at a distance from the teat 4, which has no influence on the air valve.

In this example, the air valve, or more exactly its diaphragm 23, is arranged in a circumferential surface of the truncated cone 25. Its diaphragm 23 preferably has a circular shape. However, it can also have another shape, for example annular, oval or elliptic. The diaphragm 23 has an approximately planar main surface 232, which is preferably flush with the circumferential surface of the truncated cone 25 or extends parallel thereto. An air through-flow opening 230 is present in this main surface 232. This air through-flow opening 230 is preferably permanently open, i.e. it is formed by material being cut out. Preferred cross-sectional surface areas of the opening are 0.2-1 mm. This air through-flow opening 230 is preferably located in an elevation above the main surface 232, here in a truncated cone 231. The truncated cone 231 preferably has a greater wall thickness compared to the main surface 232, such that the wall of the air through-flow opening 230 is strengthened. The air through-flow opening 230 is preferably located in the tip of the elevation. It is preferably located at the centre of the main surface 232. However, it can also be arranged eccentrically. The air valve is preferably arranged in the region of a slit 21.

As can be seen in FIG. 6, the diaphragm 23 of the air valve is preferably connected to the lower sealing ring 22.

FIG. 4 shows the path by which air can enter the bottle 1 from the outside. The path followed by the air is indicated by arrows in the figure. The hollow space between base part 2 and receiving head 3 thus forms an air channel. The threaded connection between receiving head 3 and bottle 1 is not completely tight, such that air from the outside can pass through the slit to the upper surfaces of the webs 210 of the base part 2. Here, the air passes through the at least one air opening 281 in the outer sealing edge 28 to the surface of the truncated cone 25. It flows across this surface as far as the air valve and, when the air valve is opened, passes into the bottle 1.

Figure 8:
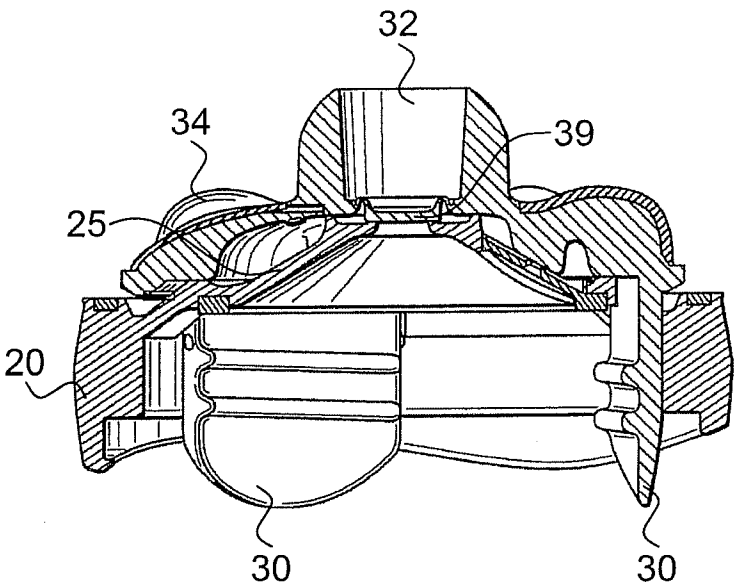
FIG. 8 shows a longitudinal section through the receiving head and the base part according to FIG. 7.
Figure 12:
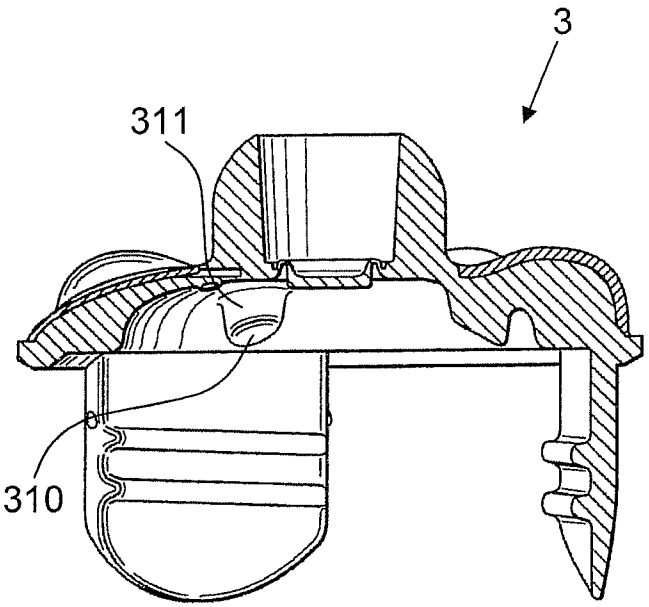
FIG. 12 shows a longitudinal section through the receiving head according to FIG. 11.
Figure 11:
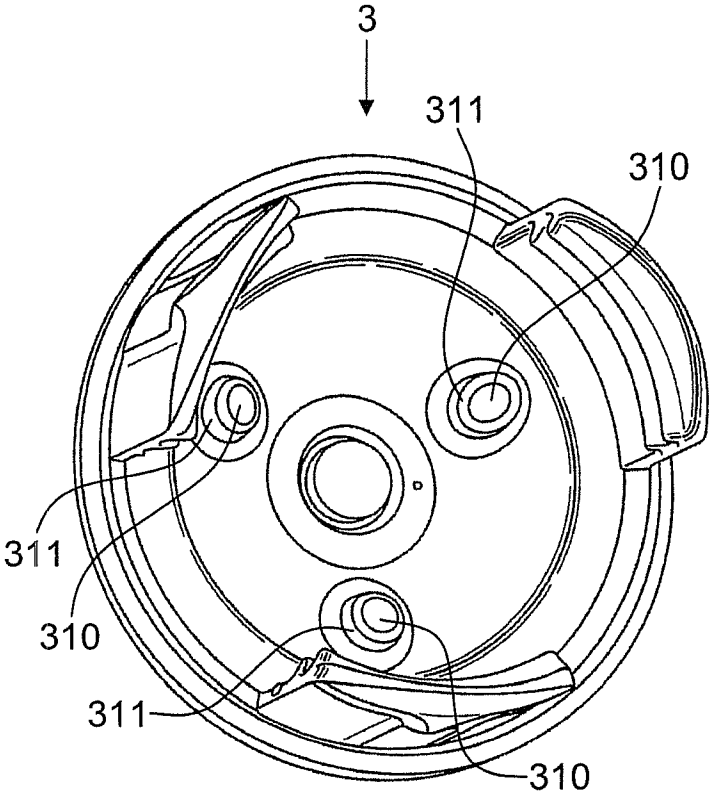
FIG. 11 shows a perspective view of the receiving head from below.

The air valve is shown in FIG. 8 and in an enlarged view in FIGS. 9 and 10, in the closed position and opened position. On its underside, the receiving head 3 has a planar valve closure surface 310. This closure surface 310 can be seen clearly in FIGS. 11 and 12. The main body 31 for this purpose has at least one, preferably several downwardly protruding closure bodies 311, the free ends of which are formed by the planar closure surfaces 310. The closure surfaces 310 preferably have the same inclination as the circumferential surface of the truncated cone 25. The closure bodies 311 are preferably present in the same number as there are rotation positions for plugging base part 2 and receiving head 3 together. In this example, there are three slits 21, for which reason there are three rotation positions of the receiving head 3 relative to the base part 2 and thus also three closure bodies 311.

As can be seen from FIG. 9, one of the three closure bodies 310 presses onto the truncated cone 231 of the air valve and the closure surface 310 bears on the diaphragm 23 and closes the air through-flow opening 230. Since the truncated cone 231 forms a small bearing surface, the surface pressure is increased and optimal sealing ensured. The leaktightness can be further increased when the upper margin of the truncated cone 231 is pointed, as is shown here.

If liquid is now sucked from the bottle 1 via the suction opening 43, the pressure in the bottle 1 reduces and the air valve is opened. Air from the outside passes into the bottle 1. Should liquid emerge from the air valve, the long labyrinthine path shown in FIG. 4 ensures that liquid cannot escape to the outside. It preferably remains lying on the circumferential surfaces of the funnel or truncated cone 25. The liquid left lying there can be removed again easily when the teat unit is cleaned, since these circumferential surfaces of the truncated cone 25 are exposed and optimally accessible for cleaning when the teat unit is dismantled.

The air valve according to the invention, in its special design and arrangement, can nonetheless also be used in differently configured teat units. It is simply necessary that a diaphragm valve be used and that this valve is not arranged in the teat but instead in a two-piece or multiple-piece securing part for securing the teat.

For example, the diaphragm of the air valve can also be arranged in the receiving head, and the base part has a corresponding closure for the air through-flow opening.

The teat unit according to the invention functions very reliably even at very small pressure differences, e.g. of 30 mmHg, between the bottle and the environment. Moreover, the range of function of the various teat units of the same type is relatively narrow, such that different teat units function very similarly and the air valves are actuated at similar pressure differences.

Various exemplary embodiments and methods have been described above. Those skilled in the art will understand, however, that changes and modifications may be made to those examples without departing from the scope and spirit of the present invention. It should be further noted that the above overview is meant to be illustrative, not limiting. That is, additional and/or different features may be present in some embodiments of the present invention.

The invention claimed is:

1. A teat unit including a teat, a securing device for securing the teat on a liquid container, and an air valve, the securing device having a first securing part and a second securing part, and the air valve having at least a first valve part and a second valve part, wherein the first and second securing parts are each rigid, at least in the area of the air valve, wherein a) the first valve part is arranged in the first securing part, and the second valve part is arranged in the second securing part; or b) the air valve opens or closes with respect to the second securing part and the first valve part and the second valve part are arranged in the first securing part, wherein the first securing part has an annular main body and a truncated cone formed integrally in the annular main body, wherein a liquid through-flow channel extends along a longitudinal center axis of the truncated cone, and wherein the diaphragm of the air valve is arranged in a circumferential surface of the truncated cone.

2. The teat unit according to claim 1, wherein the teat can be clamped sealingly between the two securing parts.

3. The teat unit according to claim 1, wherein the air valve is a diaphragm valve, and the first part is a valve diaphragm.

4. The teat unit according to claim 1, wherein the first and second securing parts can be connected to each other.

5. The teat unit according to claim 1, wherein the teat is arranged independently of the air valve.

6. The teat unit according to claim 1, wherein the first and second securing parts form an air channel that opens into at least one air opening leading to the outside.

7. The teat unit according to claim 1, wherein the diaphragm has an air through-flow opening that is designed permanently open and that can be closed by means of the second securing part.

8. The teat unit according to claim 7, wherein the air through-flow opening is strengthened at a circumference of the air through-flow opening.

9. The teat unit according to claim 7, wherein the air through-flow opening is circular, elliptical, oval or annular.

10. The teat unit according to claim 7, wherein the diaphragm has a substantially planar main surface and a truncated cone arranged in the main surface, the air through-flow opening being arranged in the truncated cone.

11. The teat unit according to claim 1, wherein the diaphragm is secured about an entire periphery of the diaphragm in the first securing part.

12. The teat unit according to claim 1, wherein the first securing part has a circumferential sealing ring for bearing in a leaktight manner on an end face of the liquid container, and wherein the diaphragm and the sealing ring are preferably designed together in one piece.

13. The teat unit according to claim 1, wherein the first securing part is a base part and the second securing part is a receiving head, wherein the receiving head and the base part can be connected to each other via a releasable plug connection, wherein the receiving head for this purpose has plug elements that can be plugged into the base part and that are designed to secure the assembled base part and receiving head on the liquid container.

14. The teat unit according to claim 1, wherein the diaphragm of the air valve is substantially flush with the circumferential surface of the truncated cone.

15. A nipple apparatus for a feeding bottle having a pressure regulating feature, comprising:

a flexible teat having an internal conduit through which liquid passes from a supply to an exit port;

a securing device attaching said teat to a container, said securing device having first and second securing parts, said first securing part being located toward a container interior relative to said second securing part;

a valve element provided on said first securing part, said valve element having a first valve part which is movable relative to said first securing part, with an orifice formed in said first valve part communicating with the container interior, said second securing part having a portion against which said first valve part engages to thereby close said orifice in a first state;

a channel for ambient air to enter between said first and second securing parts and pass through said orifice into the container interior in a second state, said channel being closed to the container interior in said first state, the container interior otherwise being sealed against entry of air by said securing device;

said first valve part moving away from said portion of said second securing part and toward the container interior upon removal of liquid through said teat internal conduit to thereby open said channel for air to pass, the removal of liquid creating an underpressure in the container interior in said second state.

16. A teat unit including a teat, a securing device for securing the teat on a liquid container, and an air valve, the securing device having a first securing part and a second securing part, and the air valve having at least a first valve part and a second valve part, wherein a) the first valve part is arranged in the first securing part, and the second valve part is arranged in the second securing part; or b) the air valve opens or closes with respect to the second securing part and the first valve part and the second valve part are arranged in the first securing part; and wherein the first securing part is a base part and the second securing part is a receiving head, wherein the receiving head and the base part can be connected to each other via a releasable plug connection, wherein the receiving head for this purpose has plug elements that can be plugged into the base part and that are designed to secure the assembled base part and receiving head on the liquid container.

17. A teat unit including a teat, a securing device for securing the teat on a liquid container, and an air valve, the securing device having a first securing part and a second securing part, and the air valve having at least a first valve part and a second valve part, wherein a) the first valve part is arranged in the first securing part, and the second valve part is arranged in the second securing part; or b) the air valve opens or closes with respect to the second securing part and the first valve part and the second valve part are arranged in the first securing part; and wherein the first securing part has an annular main body and a truncated cone formed integrally in the annular main body, wherein a liquid through-flow channel extends along a longitudinal center axis of the truncated cone, and wherein the diaphragm of the air valve is arranged in a circumferential surface of the truncated cone.

* * * * *